US006364180B1

(12) United States Patent
Cardenas

(10) Patent No.: US 6,364,180 B1
(45) Date of Patent: Apr. 2, 2002

(54) CONTAINER FOR DISPENSING OIL INTO AN ENGINE

(76) Inventor: Alberto C. Cardenas, 5417 Callaghan Rd., San Antonio, TX (US) 78228

( * ) Notice: Subject to any disclaimer, the term of this patent is extended or adjusted under 35 U.S.C. 154(b) by 0 days.

(21) Appl. No.: 09/725,538

(22) Filed: Nov. 29, 2000

(51) Int. Cl.[7] ..... B65D 47/10

(52) U.S. Cl. ..... 222/541.2; 141/329; 141/366; 222/153.06; 222/541.6

(58) Field of Search ..... 141/114, 329, 141/366; 215/232, 41, 42, 43, 44, 45; 222/153.05, 153.06, 541.2, 541.6

(56) References Cited

U.S. PATENT DOCUMENTS 2,687,829 A * 10/1954 Horrocks ..... 222/83
3,128,016 A * 4/1964 Ferri ..... 222/212
5,123,570 A * 6/1992 Dubow et al. ..... 222/83
5,533,553 A * 7/1996 Vesborg ..... 141/319
5,566,859 A * 10/1996 Willis et al. ..... 222/83.5

* cited by examiner

*Primary Examiner*—Kevin Shaver
*Assistant Examiner*—Melvin Cartagena
(74) *Attorney, Agent, or Firm*—Jackson Walker LLP

(57) ABSTRACT

A container for dispensing oil or other fluid medium into an engine or other receptacle. The container has a body with a pair of necks concentrically arranged, including an inner neck and an outer neck. The removed ends of both necks are covered with a frangible member. When the oil container is inverted and placed over the engine oil inlet the frangible member prevents oil leakage until the container is pushed against the oil inlet, then it breaks and inserts the inner neck into the engine oil inlet with outer neck being outside the circumference of the engine oil inlet.

18 Claims, 3 Drawing Sheets

CONTAINER FOR DISPENSING OIL INTO AN ENGINE

FIELD OF THE INVENTION

A container for dispensing oil or other fluid medium into an engine or other receptacle, more particularly an oil container having a body with a pair of necks, the necks including an inner neck and outer neck, wherein, the removed ends of both necks, are covered with a frangible member.

BACKGROUND OF THE INVENTION

Engines, such as the internal combustion engine of an automobile usually require regular oil changes or additions of oil or additives. Oil usually comes in plastic one quart containers. It is poured into the engine directly from the container without the use of funnels. This is often a messy job, especially if done outside of automobile shops. The oil fill opening is usually near the top of the engine and vertically oriented (depending on the make or model of the vehicle). There is, typically, not a lot of room to work around the oil fill opening and it is necessary to properly align the opening of the oil container with the oil fill opening of the engine before pouring. If there is any misalignment or if the oil comes out too fast the result can be oil on the engine. Not only does this create an unwholesome appearance but it may also create unnecessary heating of the engine or even a fire hazard when the engine warms up and fresh oil is resting on hot manifold parts.

There have been a number of attempts by others to overcome the difficulties encountered when pouring oil from an oil container into an engine. These attempts at solving this problem have met with some limited success but none has combined in a simple, easy to manufacture container a foolproof means for inverting the oil container and properly aligning it with the engine oil inlet before even a drop of oil fill leaves the container.

OBJECTS OF THE INVENTION

Thus, it is the object of Applicant's invention to provide for a simple, convenient, effective oil container for transporting and for dispensing oil from the container into the engine without spilling a drop.

SUMMARY OF THE INVENTION

This and other objects are provided in oil container having a body, an inner neck and an outer neck. The inner neck is for dispensing oil and the outer neck encloses the inner neck. A frangible member made from either plastic, foil, cellophane or other suitable material seals across the open, removed ends of the two (2) necks. The two necks are dimensioned such that a typical oil fill inlet for an engine has a radius greater than the inner neck but less than the outer neck. Therefore, the container may be inverted, aligned and placed over the oil fill inlet of the engine and then pushed down, with the edge of the oil inlet of the engine breaking the frangible member while the inner neck simultaneously pushes through the frangible member allowing the inner neck into the oil inlet of the engine. The inner neck inside the oil inlet also balances the container to where it is not necessary for the user to hold it.

DETAILED DESCRIPTION OF THE PREFERRED EMBODIMENTS

Figure 1:
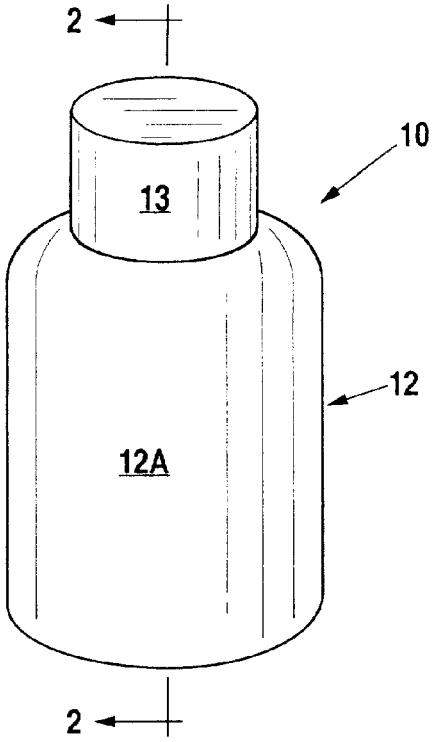
Figure 2:
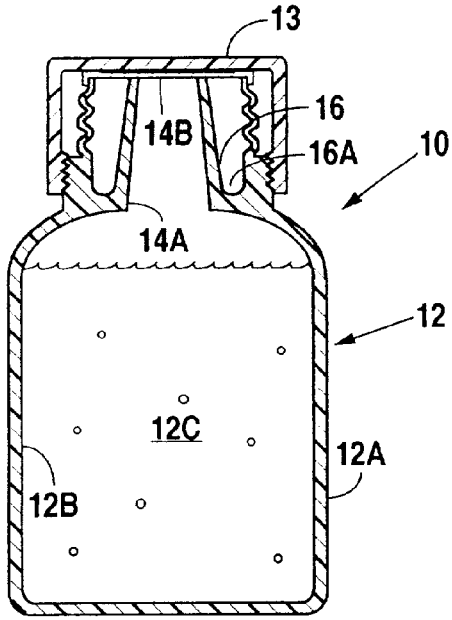

FIGS. 1 and 2 illustrate Applicant's novel oil container (10). It is seen to comprise a body (12). The body (12) may be plastic or the suitable means and is constructed similar to other oil containers. It is seen to have outer walls (12A) and inner walls (12B) and to define an interior portion (12C) thereof. It may be round, oval or any other suitable shape. It is seen also to have threads (12D) thereon for threadably engaging a cap (13) thereto. Nothing herein so far set forth describes anything novel or different from many other prior art oil containers. However, as seen with reference to FIGS. 2, 3, 3A and 4, Applicant provides an inner neck 14 in fluid communication with interior portion (12C) of body (12). Inner neck (14) has an open first end (14A) and an open, removed second end (14B). The inner neck will provide a passage way for oil to move from the interior of container (10) into the engine B, through engine oil fill inlet A (See FIG. 6).

Applicant provides second or outer neck (16) which has a diameter greater than the diameter of the inner neck and surrounds the inner neck. Outer neck (16) includes a first end (16A) typically joined to body (12) at outer walls (12A) thereof. Outer neck (16) also includes a removed, open second end (16B). It is seen with reference to FIG. 2 that open second end of the inner neck and the open second end of the outer neck both lie in the same plane. Stretched across and fully covering both openings, and sealing against the perimeters defining the two second ends of the two necks is a frangible member (18) whose surface us suggested to be preprogrammed or scored for ease of breaking away all in one piece. The frangible member may be made of plastic, foil or other suitable material, but is sealed with glue or other adhesive means around the perimeter of the second end of the inner neck in a manner that will allow the frangible member (18) to tear or break away from the inner neck and remain in one piece (See FIG. 3B) when a force is placed on the frangible member between the inner and outer necks as seen with reference to FIGS. 6 and 6A.

Figure 5:
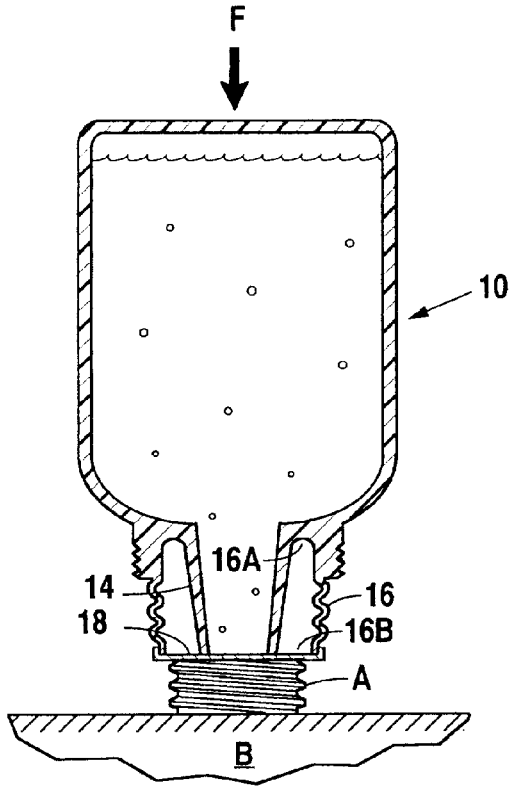

The frangible member serves to seal the oil within interior portion (12C) even when the container is inverted as is set forth in FIG. 5. Thus, there is typically a suitable sealant along the perimeter of the second end of inner neck (14) and another sealant along the second the outer neck (16), the frangible member breaking and separating across the inner neck. However, frangible member (18) should be, scored in such a manner (See FIGS. 3 and 3A) that when a force is applied in a region between the inner and outer neck to the frangible member, it will stay in one piece but will tear away or break way from the second end of the inner neck, but not from where it sealed to the second end of the outer neck (see FIG. 6).

Figure 6:
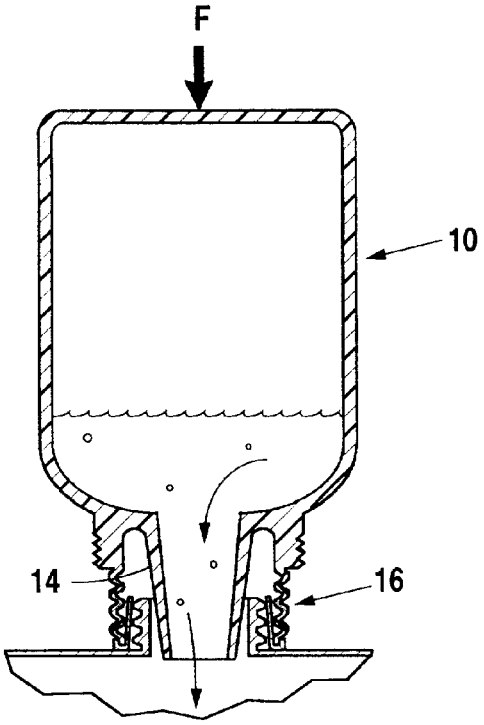

Thus, it may be seen that with reference to FIG. 5, Applicant's container can be inverted and placed against an oil inlet lift A typically defining a lip, of an engine B, without the fear of spilling the oil. When a proper alignment is effected so that inner neck (14) is centered within the lip A and outer neck (16) is outside of lip A, a downward force on the container (10) will cause frangible member (18) to pull away and allow the oil to pour into the engine as seen in FIG. 6.

Figure 6A:
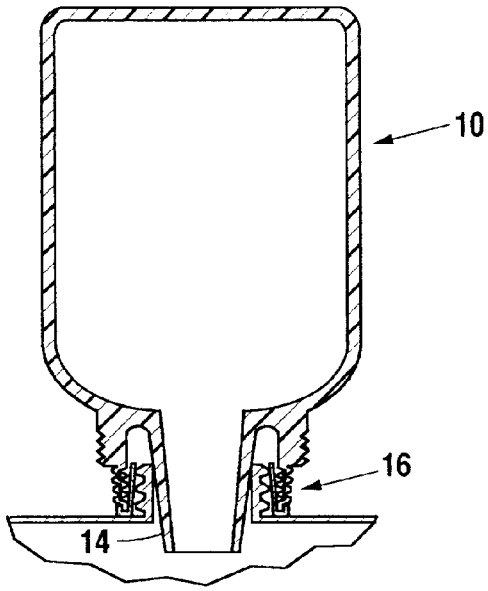

It is seen that outer neck (16) may be accordioned or ribbed for ease in compressing with the downward force as seen in the accompanying illustrations. Indeed, outer neck can be ribbed and be sufficiently weak so that a downward palm thrust on the container will cause the outer neck to actually collapse, as seen in FIG. 6A, as a result of the removed end thereof striking the engine while application of force F is continued. In other words, outer neck 16 can be either collapsible or non-collapsible. It need not be ribbed, although a ribbed neck is shown to illustrate the collapsible optional embodiment of Applicant's novel container (10), in other embodiments it may be smooth.

Figure 7:
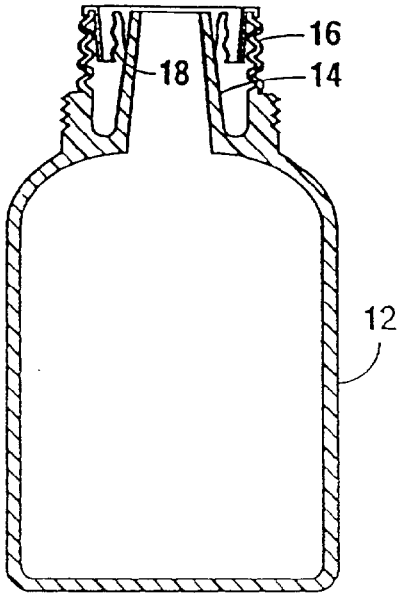
Figure 7A:
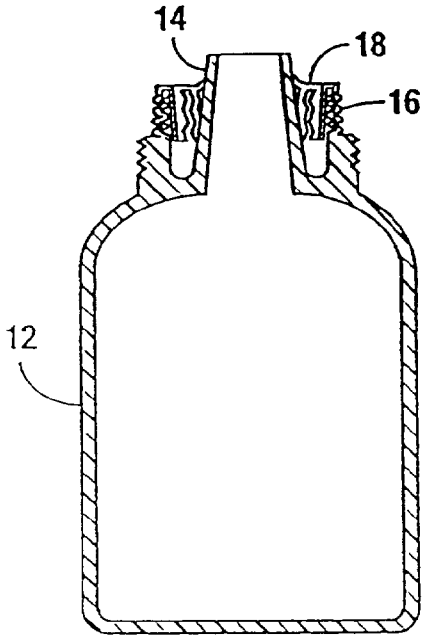

FIG. 7 illustrates the empty container of the non-collapsible outer neck after the oil has been poured into the engine. FIG. 7A illustrates the embodiment with the collapsible outer neck after the oil has been dispensed. Note in both cases that frangible member (18) has torn away from second end at inner neck (14), but not from outer neck (16). The inner neck goes deep enough into the engine oil fill to where the user does not need to hold the oil container while it empties. If so user would need to hold the oil container because it doesn't go deep into the engine oil fill inlet.

Figure 3:
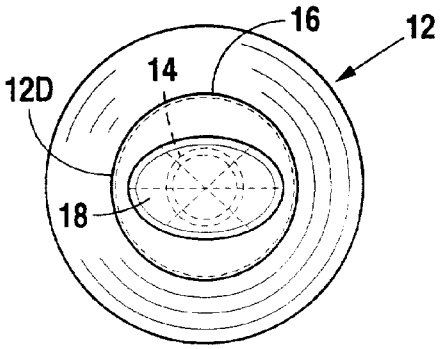
Figure 3B:
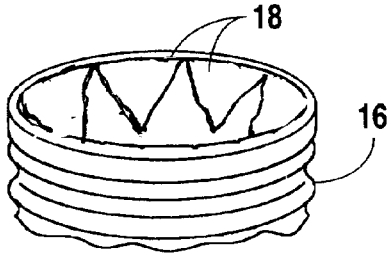
Figure 3A:
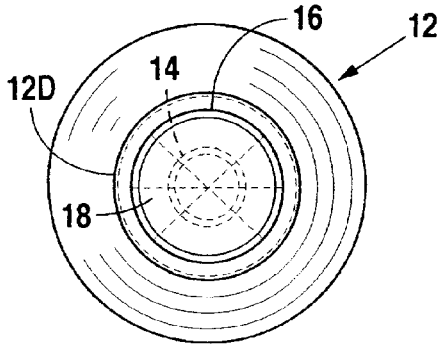
Figure 3C:
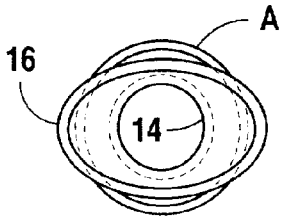
Figure 4:
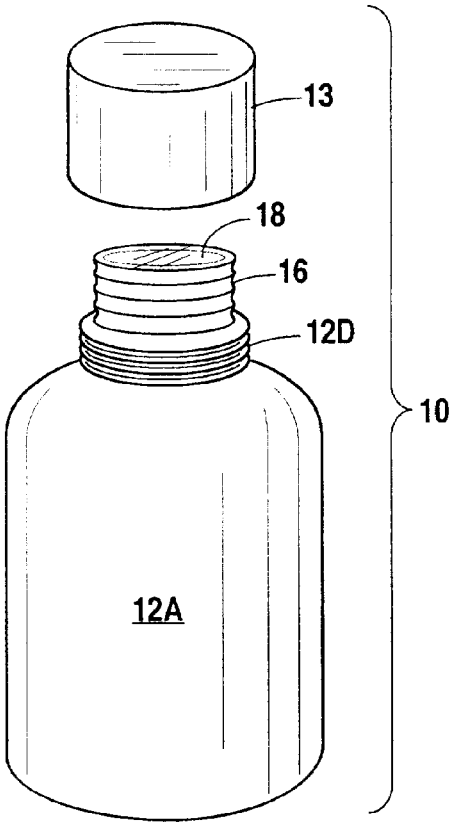

Compare FIGS. 3 and 3A. In FIG. 3 it is seen that the shape of the second end of the outer neck is oval or elliptical. In this embodiment, the short axis of the second end opening is less than the diameter of a typical oil fill inlet, which is typically about 1½ inches. The long axis is greater than the diameter of the engine oil fill inlet. Further, the outer neck is collapsible. Therefore, when inverted and placed over the oil fill inlet, the relative position of the second end of the inner neck, the outer neck and lip of the oil fill inlet are as represented in FIG. 3C. When one pushes downward as in FIG. 5, the frangible member breaks, the outer neck collapses against the outer lip of the oil fill inlet instead of against the engine as seen in FIG. 6A, and the inner neck is thrust into the oil fill inlet as seen in FIG. 6A. Either 3 or 3A is optional, as long as the inner neck goes deep enough into the engine oil fill to balance the container as it empties.

Figure 8A:
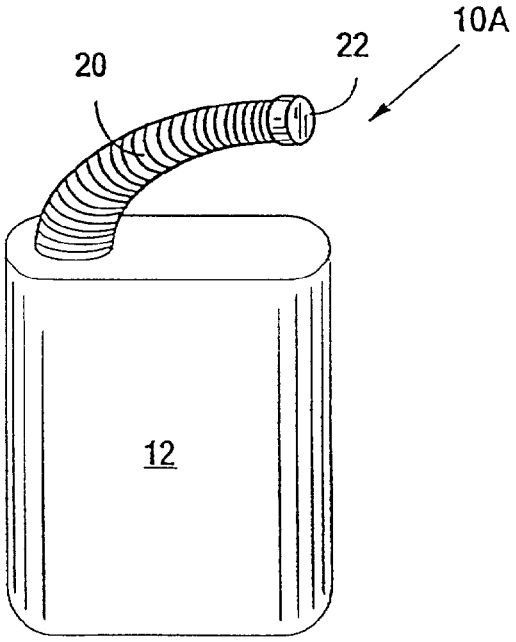
Figure 8B:
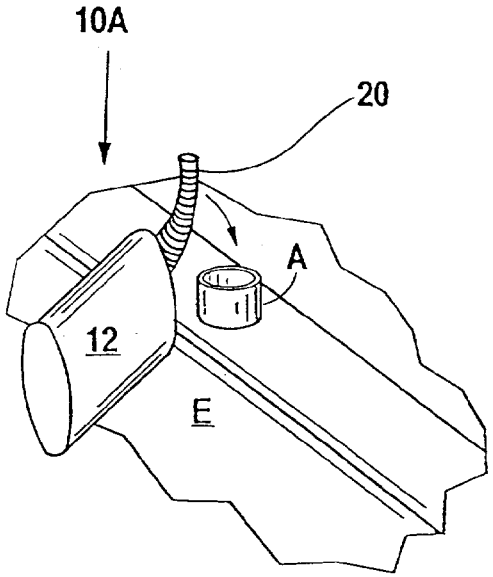

FIGS. 8A and 8B illustrates an alternative preferred embodiment of Applicant's present invention. In this embodiment, there is single neck (20) made of a flexible ribbed or accordioned material that can be bent in a variety of directions. The neck is sufficiently long so that the removed opening, here covered with cap (22), can be aligned perpendicular to the longitudinal axis of body (12). In this embodiment there is no inner or outer neck, just a single flexible neck (20), of sufficient length with the cap (22) at the removed end thereof. One need only to place container with its flexible neck upward as shown in FIG. 8B and over the engine oil fill. Once aligned just a twist or the wrist will ease the neck spout into engine fill. Then straighten the neck to permit it to go further in and balance itself without the user having to hold the container while it empties.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A container for dispensing oil primarily into an engine, the container comprising:

walls defining a body, the body having an exterior wall and an interior portion, the interior portion capable of containing oil therein;

an inner neck, the inner neck having an open first end and an open second end, the inner neck joining the body at the first end thereof;

an outer neck, the outer neck having a first end, the first end integral with the exterior wall of the body and an open second end and, co-planer with, but surrounding the second end of the inner neck to create a ring between the second end of the inner neck and the second end of the outer neck;

a frangible, planer member, the frangible, planer member for sealing both the second end of the inner neck and the second end of the outer neck in fluid tight fashion, the frangible, planer member capable of breaking away from the second end of the inner neck upon the application of a palm thrust force adjacent the ring between the two second ends;

wherein, breakage of the frangible member will allow oil to flow from the interior portion of the body through the second end of the inner neck.

2. The container of claim 1 further including a cap, attachable to the body so as to enclose both the inner neck and the outer neck and the frangible member.

3. The container of claim 2, wherein the cap is removably attached to the body.

4. The container of claim 3, wherein the cap and body both include matching threads for removable attachment of the cap to the body.

5. The container of claim 1, wherein the frangible member is foil.

6. The container of claim 1, wherein the frangible member is plastic.

7. The container of claim 1, wherein the frangible member is transparent.

8. The container of claim 1, wherein the frangible member is scored.

9. The container of claim 1, wherein the second opening of the outer neck is oval and the second opening of the inner neck is round.

10. The container of claim 1, wherein the body is made of plastic.

11. The container of claim 1, wherein the frangible member is transparent.

12. The container of claim 11, further including a cap, the cap attachable to the body in a manner to enclose both the inner and the outer neck and the frangible member.

13. The container of claim 1, wherein the outer neck is collapsible.

14. The container of claim 13, wherein the second opening of the outer neck is oval and the second opening of the inner neck is round.

15. The container of claim 12, wherein the frangible member is made up of one of the following: foil, cellophane or plastic.

16. The container of claim 12, wherein the frangible member is scored.

17. The container of claim 12, wherein the frangible member is transparent.

18. The container of claim 12, wherein the frangible member is scored and is made from one of the following foil, cellophane or plastic.

* * * * *